US012366398B2

(12) United States Patent
Chu et al.

(10) Patent No.: US 12,366,398 B2
(45) Date of Patent: Jul. 22, 2025

(54) INTELLIGENT ICE SUPPLY DEVICE AND APPARATUS HAVING THE INTELLIGENT ICE SUPPLY DEVICE

(71) Applicant: Chien-Jung Chu, Kaohsiung (TW)

(72) Inventors: Chien-Jung Chu, Kaohsiung (TW); Chang-Hsi Wu, New Taipei (TW); Fei-Teng Ko, Kaohsiung (TW)

(73) Assignee: Chu Chien-Jung, Kaohsiung (TW)

( * ) Notice: Subject to any disclaimer, the term of this patent is extended or adjusted under 35 U.S.C. 154(b) by 243 days.

(21) Appl. No.: 18/133,923

(22) Filed: Apr. 12, 2023

(65) Prior Publication Data

US 2023/0341167 A1 Oct. 26, 2023

(30) Foreign Application Priority Data

Apr. 25, 2022 (TW) ..... 111115545

(51) Int. Cl.
*F25C 5/14* (2006.01)
*F25C 5/182* (2018.01)

(52) U.S. Cl.
CPC ..... *F25C 5/14* (2013.01); *F25C 5/182* (2013.01); *F25C 2500/08* (2013.01)

(58) Field of Classification Search
CPC ..... F25C 5/14; F25C 5/18; F25C 5/182
See application file for complete search history.

(56) References Cited

U.S. PATENT DOCUMENTS

| | | | | |
|---|---|---|---|---|
| 3,075,363 | A | 1/1963 | Conto | |
| 3,192,734 | A | 7/1965 | Swanson | |
| 4,132,049 | A * | 1/1979 | Mullins, Jr. ..... | G07F 11/44 53/384.1 |
| 5,165,255 | A | 11/1992 | Alvarez et al. | |

FOREIGN PATENT DOCUMENTS

| | | | |
|---|---|---|---|
| CN | 210242118 | U | 4/2020 |
| CN | 112728827 | A | 4/2021 |
| DE | 19639475 | A1 | 4/1998 |
| JP | 200814539 | A | 1/2008 |
| JP | 7520283 | B2 | 7/2024 |
| TW | I737553 | B | 8/2021 |
| TW | M633605 | U | 11/2022 |
| WO | WO 2006137038 | A1 | 12/2006 |

* cited by examiner

*Primary Examiner* — Elizabeth J Martin
(74) *Attorney, Agent, or Firm* — Li & Cai Intellectual Property (USA) Office

(57) ABSTRACT

An intelligent ice supply device and an apparatus with the intelligent ice supply device. The intelligent ice supply device includes an ice storage container, an agitating bar, a plurality of agitating plates, a plurality of ice partitions and a driving device. The agitating bar is rotatably located in the ice storage container. The agitating plates are horizontally connected to the agitating bar and located between an upper and a lower side portion of the agitating bar. The ice partitions are vertically connected to the lower side portions of the agitating bars. The driving device is connected to the upper side portion of the agitating bar and can be used to drive the agitating bar, the agitating plates and the ice partitions to automatically supply ice cubes, and the driving device can also drive the agitating bar, the agitating plates and the ice partitions to automatically eliminate ice jamming.

4 Claims, 12 Drawing Sheets

INTELLIGENT ICE SUPPLY DEVICE AND APPARATUS HAVING THE INTELLIGENT ICE SUPPLY DEVICE

CROSS-REFERENCE TO RELATED PATENT APPLICATION

This application claims the benefit of priority to Taiwan Patent Application No. 111115545, filed on Apr. 25, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an ice supply device, and more particularly to an intelligent ice supply device capable of automatically supplying ice cubes and automatically eliminating the phenomenon of ice jamming, and an apparatus having the intelligent ice supply device.

BACKGROUND OF THE DISCLOSURE

The ice supply device has been widely used in restaurants, beverage stores, bars and other places where a large amount of ice cubes are consumed. However, the prior ice supply device can only supply ice cubes manually and cannot automatically eliminate the phenomenon of ice jamming In addition, in order to increase the efficiency of beverage mixing, the inventor has invented an intelligent beverage mixing apparatus (such as patent number TWI737553), which can automatically collect various beverages and appropriate amount of ice cubes according to different needs of the user to form a prepared beverage supply to the user. It seems that there are no shortcomings, but based on the spirit of excellence, the inventor hopes that the improvement of the present disclosure can make the intelligent beverage mixing apparatus with the ice supply device more ideal and perfect.

SUMMARY OF THE DISCLOSURE

In response to the above-referenced technical inadequacy, the present disclosure provides an intelligent ice supply device and an apparatus having the intelligent ice supply device, which can reduce and automatically eliminate the ice jamming phenomenon through structural design and control means.

In order to solve the above-mentioned problems, one of the technical aspects adopted by the present disclosure is to provide an intelligent ice supply device configured to automatically supply ice cubes and automatically eliminate a phenomenon of ice jamming, which includes an ice storage container, an agitating bar, a plurality of agitating plates, a plurality of ice partitions and a driving device. The ice storage container has an ice outlet. The agitating bar is rotatably disposed in the ice storage container, and the agitating bar has an upper side portion and a lower side portion respectively disposed on two opposite sides thereof The agitating plates are horizontally connected to the agitating bar and disposed between the upper side portion and the lower side portion of the agitating bar. The ice partitions are vertically connected to the lower side portion of the agitating bar. The driving device is connected to the upper side portion of the agitating bar and configured to rotate the agitating bar, the agitating plates and the ice partitions so as to automatically supply the ice cubes, and the driving device is configured to vibrate the agitating bar, the agitating plates and the ice partitions so as to automatically eliminate the phenomenon of ice jamming In order to solve the above-mentioned problems, one of the technical aspects adopted by the present disclosure is to provide an intelligent beverage mixing apparatus, which is used for mixing beverages and injecting the prepared beverages into at least one drinking cup. The intelligent beverage mixing apparatus has an intelligent ice supply device, which can add a proper amount of ice cubes to the beverage through the intelligent ice supply device, so that the prepared beverage can be automatically supplied to the user according to different needs of the user. Moreover, the intelligent beverage mixing apparatus includes an intelligent ice supply device and a material storage device. The material storage device includes at least one beverage barrel having at least one outlet, and the outlet is connected with the ice outlet of the intelligent ice supply device through a collecting mechanism. Furthermore, the intelligent ice supply device is configured to automatically supply ice cubes and automatically eliminate a phenomenon of ice jamming, which includes an ice storage container, an agitating bar, a plurality of agitating plates, a plurality of ice partitions and a driving device. The ice storage container has an ice outlet. The agitating bar is rotatably disposed in the ice storage container, and the agitating bar has an upper side portion and a lower side portion respectively disposed on two opposite sides thereof The agitating plates are horizontally connected to the agitating bar and disposed between the upper side portion and the lower side portion of the agitating bar. The ice partitions are vertically connected to the lower side portion of the agitating bar. The driving device is connected to the upper side portion of the agitating bar and configured to rotate the agitating bar, the agitating plates and the ice partitions so as to automatically supply the ice cubes, and the driving device is configured to vibrate the agitating bar, the agitating plates and the ice partitions so as to automatically eliminate the phenomenon of ice jamming.

In one of the possible or preferred embodiments, an ice receiving tray and at least one elastic baffle are vertically connected to a bottom of the ice receiving tray, and the agitating bar passes through the ice receiving tray so as to position the ice partitions below the at least one elastic baffle.

In one of the possible or preferred embodiments, the driving device has a driving module, a rotation angle sensing module and a control module, the driving module has a rotating shaft connected to the agitating bar, the rotation angle sensing module is configured to detect a rotation angle of the rotating shaft and correspondingly output a rotation angle data, and the control module is electrically connected to the driving module and the rotation angle sensing module; wherein the control module is configured to send a first control signal to the driving module, so that the driving module is configured to drive the rotating shaft to rotate a target rotation angle so as to control an amount of ice output; wherein an angle difference between an actual rotation angle of the rotating shaft and the target rotation angle is judged to perform position feedback control according to the rotation angle data so as to adjust the rotation angle of the rotating shaft to achieve precise positioning of the rotating shaft, and a phenomenon of ice jamming is judged according to the angle difference; wherein, when it is judged that there is the phenomenon of ice jamming, a second control signal is sent to the driving module to make the driving module drive the rotating shaft to vibrate and then rotate clockwise and counterclockwise, thereby synchronously driving the ice partitions rotates clockwise and counterclockwise, so that the ice cubes above the ice partitions are elastically pushed by the elastic baffle to eliminate the phenomenon of ice jamming.

In one of the possible or preferred embodiments, the control module is configured to judge whether the angle difference that is accumulated exceeds a predetermined maximum allowable value; wherein, when the angle difference that is accumulated exceeds the predetermined maximum allowable value, a third control signal is sent to the driving module, so that the driving module is configured to drive the rotating shaft to automatically return to a predetermined initial position.

In one of the possible or preferred embodiments, at least two of the elastic baffles are arranged side by side.

In one of the possible or preferred embodiments, each of the agitating plates has a horizontal piece and a slanted piece extending obliquely from a long side of the horizontal piece.

In one of the possible or preferred embodiments, each of the slanted pieces is provided with an elastic plate body.

Therefore, the intelligent ice supply device provided by the embodiment of the present disclosure and the apparatus with the intelligent ice supply device can be provided with a plurality of ice partitions located on the lower side portion of the agitating bar so as to limit the amount of ice cubes falling from the intelligent ice supply device. In addition, the driving device can be connected to the upper side portion of the agitating bar, the driving device can be used to drive the agitating bar, the agitating plates and the ice partitions to rotate, so as to automatically supply the ice cubes, and the driving device can also be used to drive the agitating bar, the agitating plates and the ice partitions to vibrate, so as to automatically eliminate the phenomenon of ice jamming Therefore, the intelligent ice supply device of the present disclosure can not only automatically supply the ice cubes according to different requirements, but also reduce and automatically eliminate ice jamming.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
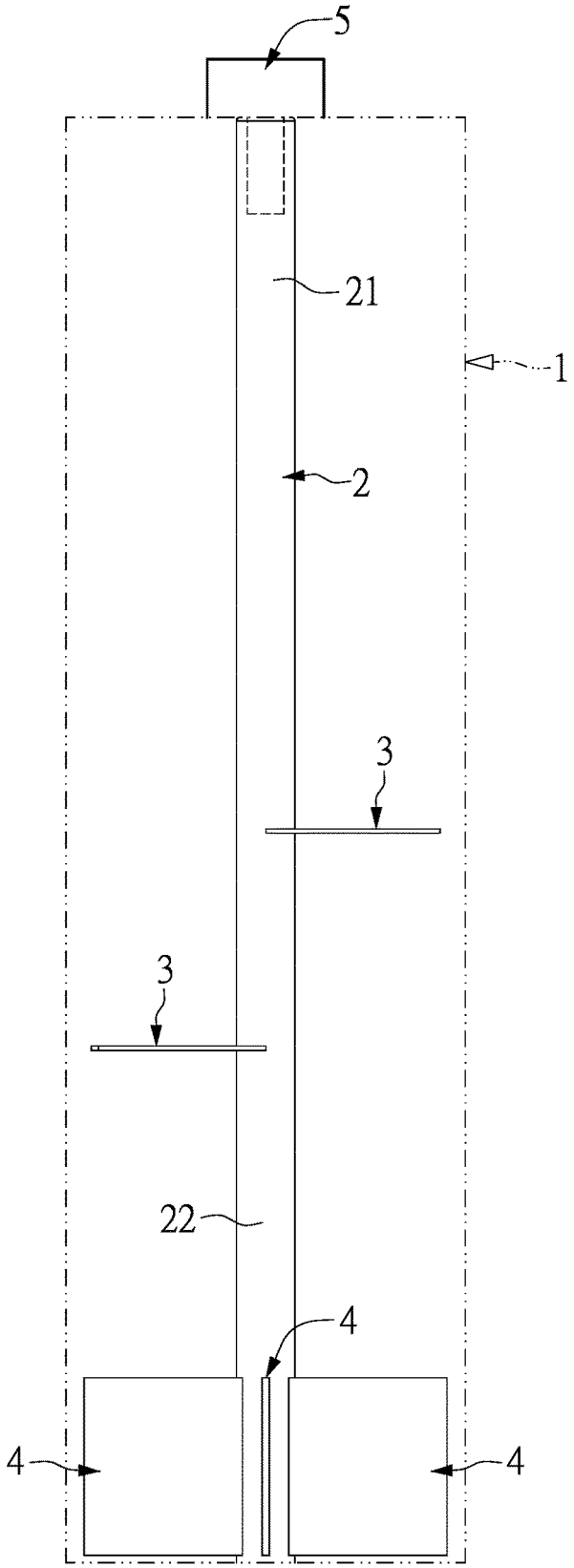
FIG. 1 is a schematic view of an intelligent ice supply device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

The present disclosure provides an intelligent ice supply device (or an intelligent ice supply device), which can reduce the phenomenon of ice jamming and automatically eliminate the phenomenon of ice jamming through structural design and control means.

First Embodiment

Figure 2:
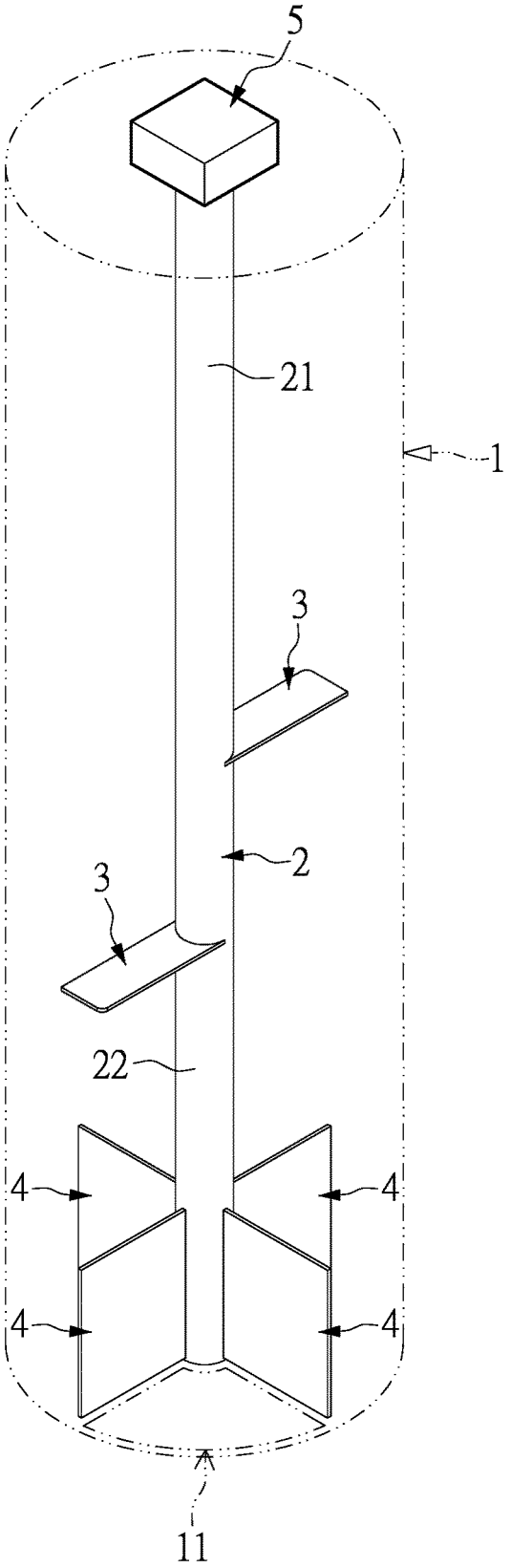
FIG. 2 is a schematic perspective view of the intelligent ice supply device according to the first embodiment of the present disclosure.

Referring to FIG. 1 and FIG. 2, the intelligent ice supply device according to the first embodiment of the present disclosure includes an ice storage container 1, an agitating bar 2 (or a stirring rod), a plurality of agitating plates 3 (or a plurality of stirring pieces or blades), a plurality of ice partitions 4 (or a plurality of ice-falling partitions), and a driving device 5.

The ice storage container 1 can be configured for storing ice cubes. The bottom of the ice storage container 1 may have an ice outlet 11 through which ice cubes can fall out. The ice storage container 1 can be in the shape of a cylinder, but can also be in various shapes without limitation. In addition, the ice cubes in the ice storage container 1 are preferably in the shape of cubes, but they can also be in various shapes without limitation.

The agitating bar 2 is rotatably located in the ice storage container 1, and the two opposite sides of the agitating bar 2 form an upper side portion 21 and a lower side portion 22, respectively. Moreover, the agitating plates 3 are horizontally connected to the agitating bar 2 and located between the upper side portion 21 and the lower side portion 22 of the agitating bar 2. The agitating plates 3 are preferably arranged at intervals from bottom to top (or arranged at intervals in the vertical direction). The agitating plates 3 of this embodiment can help to rotate and agitate the ice cubes in the ice storage container 1 to avoid sticking of the ice cubes.

The number of the ice partitions 4 of this embodiment is four, and they are arranged in pairs, but the number of the ice partitions 4 can also be two or eight, which is not limited in the present disclosure. The ice partitions 4 are vertically connected to the lower side portion 22 of the agitating bar 2 and positioned above the ice outlet 11, and an ice separation space formed between any two adjacent ones of the ice partitions 4 can be used to define a predetermined amount of ice cubes that can be accommodated in the ice separation space.

The driving device 5 is connected to the upper side portion 21 of the agitating bar 2, and can be used to drive the agitating bar 2, the agitating plates 3 and the ice partitions 4 to rotate, so as to automatically supply the ice cubes, that is to say, when taking one ice separation space as a unit to rotate the ice partitions 4, the positions of the ice separation spaces can be adjusted so as to provide a predetermined amount of ice cubes that is received in the corresponding ice separation space in advance. Moreover, the driving device 5 can be used to drive the agitating bar 2, the agitating plates 3 and the ice partitions 4 to vibrate, so as to automatically eliminate the phenomenon of ice jamming Furthermore, the driving device 5 may include a driving motor or a vibrating motor to drive the agitating bar 2, the agitating plates 3 and the ice partitions 4 to rotate and vibrate. In addition, the driving device 5 can drive the agitating bar 2, the agitating plates 3 and the ice partitions 4 to vibrate according to parameter settings or for a period of time, and the driving device 5 can also drive the agitating bar 2, the agitating plates 3 and the ice partitions 4 to vibrate or rotate according to the detection results, so as to automatically eliminate the phenomenon of ice jamming.

Second Embodiment

Referring to FIG. 3 to FIG. 8, the intelligent ice supply device according to the second embodiment of the present disclosure includes an ice storage container 1, an agitating bar 2, a plurality of agitating plates 3, a plurality of ice partitions 4, and a driving device 5, and the intelligent ice supply device can also include an ice receiving tray 6, an ice bucket 7 (such as an ice collection structure), an elastic baffle 8, and an ice outlet tray 9.

Figure 3:
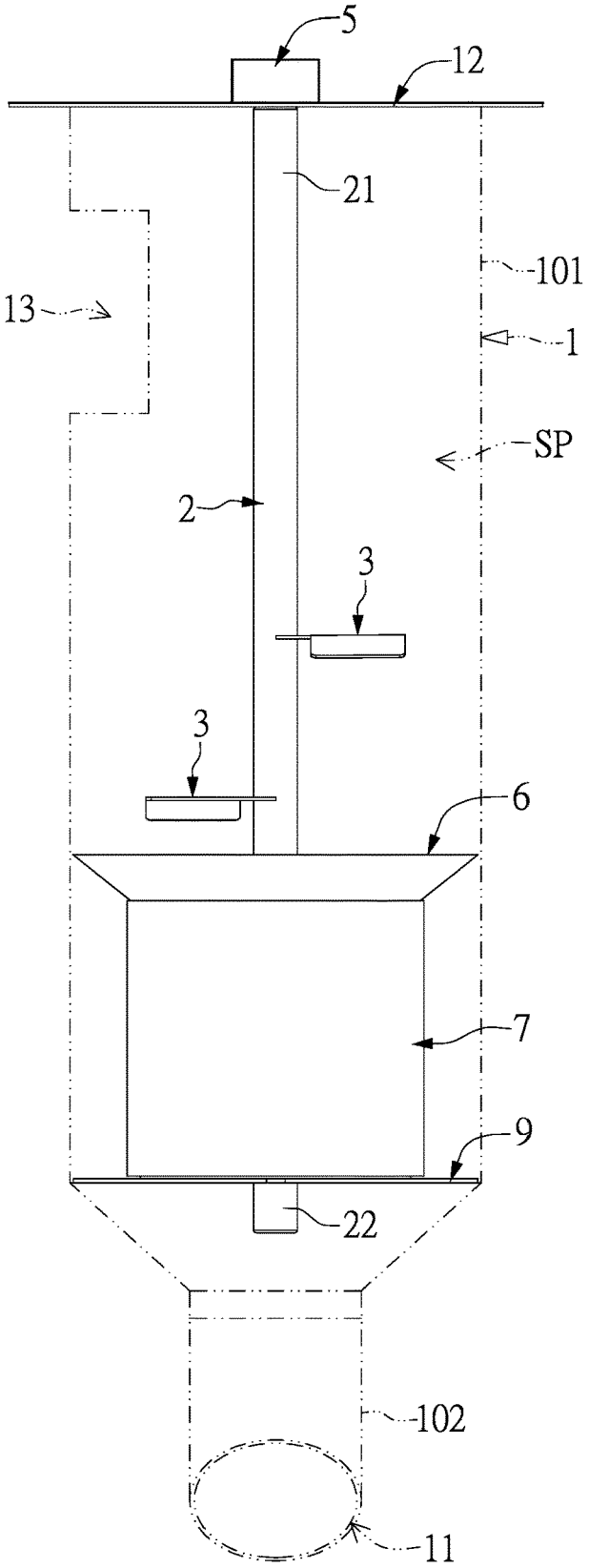
FIG. 3 is a schematic view of the intelligent ice supply device according to a second embodiment of the present disclosure.

The top of the ice storage container 1 of this embodiment is provided with a top cover 12 as shown in FIG. 3, and the side and bottom of the ice storage container 1 are respectively formed with an ice inlet 13 and an ice outlet 11. Furthermore, the ice storage container 1 of this embodiment may have a cylindrical container body 101, but may also be in the shape of a square barrel or other shapes, and the ice storage container 1 can also be an ice discharging pipe body 102 (or an ice outlet pipe body) that has a curved tubular shape or other shapes and is connected to the bottom of the container body 101. The ice inlet 13 can be formed at the side of the container body 101, and the ice outlet 11 can be formed at the bottom of the ice discharging pipe body 102.

The ice receiving tray 6 is fixed in the ice storage container 1 as shown in FIG. 3, and an ice storage space SP for storing the ice cubes can be formed between the ice receiving tray 6 and the top cover 12. That is to say, the distance between the ice receiving tray 6 and the top cover 12 can determine the size of the ice storage space SP. The ice receiving tray 6 of this embodiment is in the shape of a circular dish, but it can also be in the shape of a square dish, and the ice receiving tray 6 is formed with a first ice outlet opening 61 (or a first ice falling opening) for the ice cubes to drop down to the ice bucket 7 as shown in FIG. 5.

The ice bucket 7 is fixed below the ice receiving tray 6 as shown in FIG. 3. The ice bucket 7 of the this embodiment is a hollow bucket body having two opening respectively formed at the upper and lower sides, which can be a hollow cylindrical bucket or a hollow square bucket. The ice receiving tray 6 above the ice bucket 7 can be used to hold and receive the ice cubes to prevent a large amount of ice cubes from directly falling into the ice bucket 7. The ice receiving tray 6 of this embodiment is formed with a first ice outlet opening 61 having a semicircular shape, and a part of the ice cubes on the ice receiving tray 6 can drop down into the ice bucket 7 through the first ice outlet opening 61.

Figure 4:
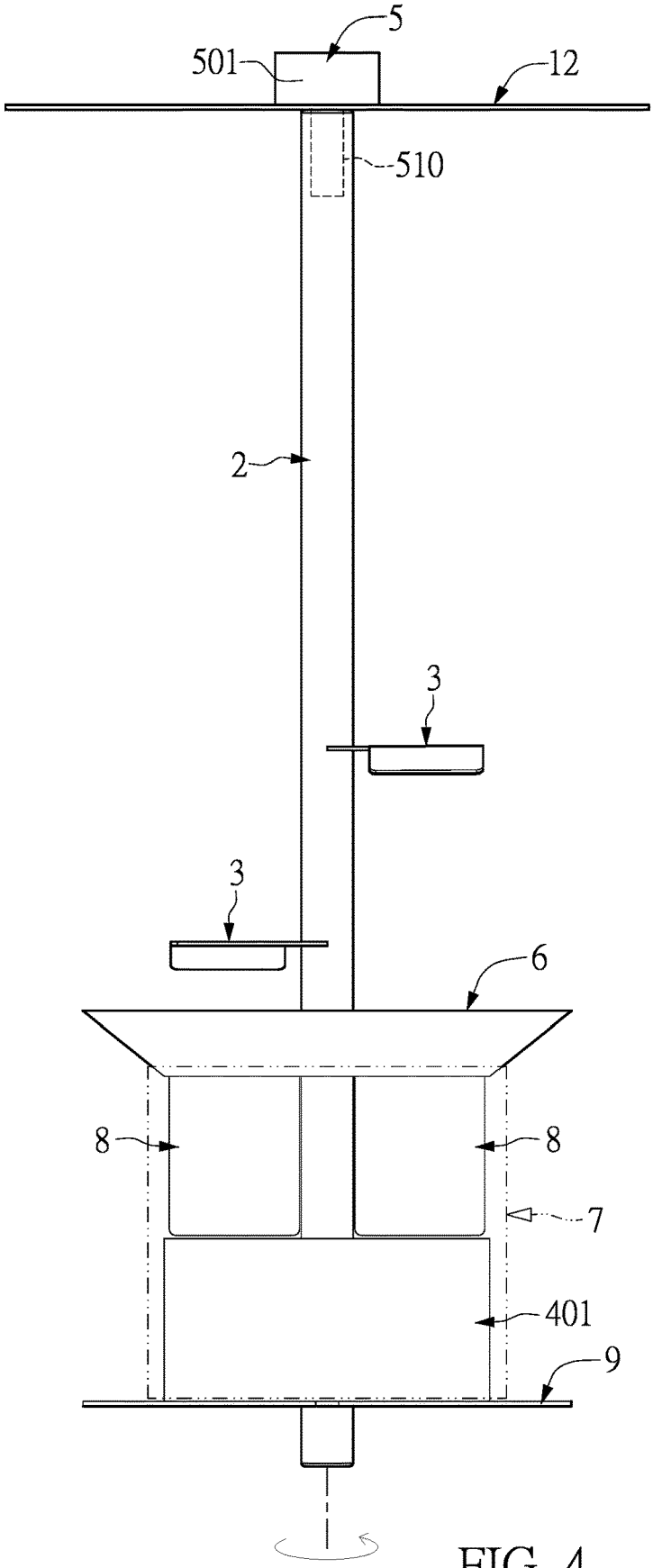
FIG. 4 is a partial schematic view of the intelligent ice supply device according to the second embodiment of the present disclosure.
Figure 5:
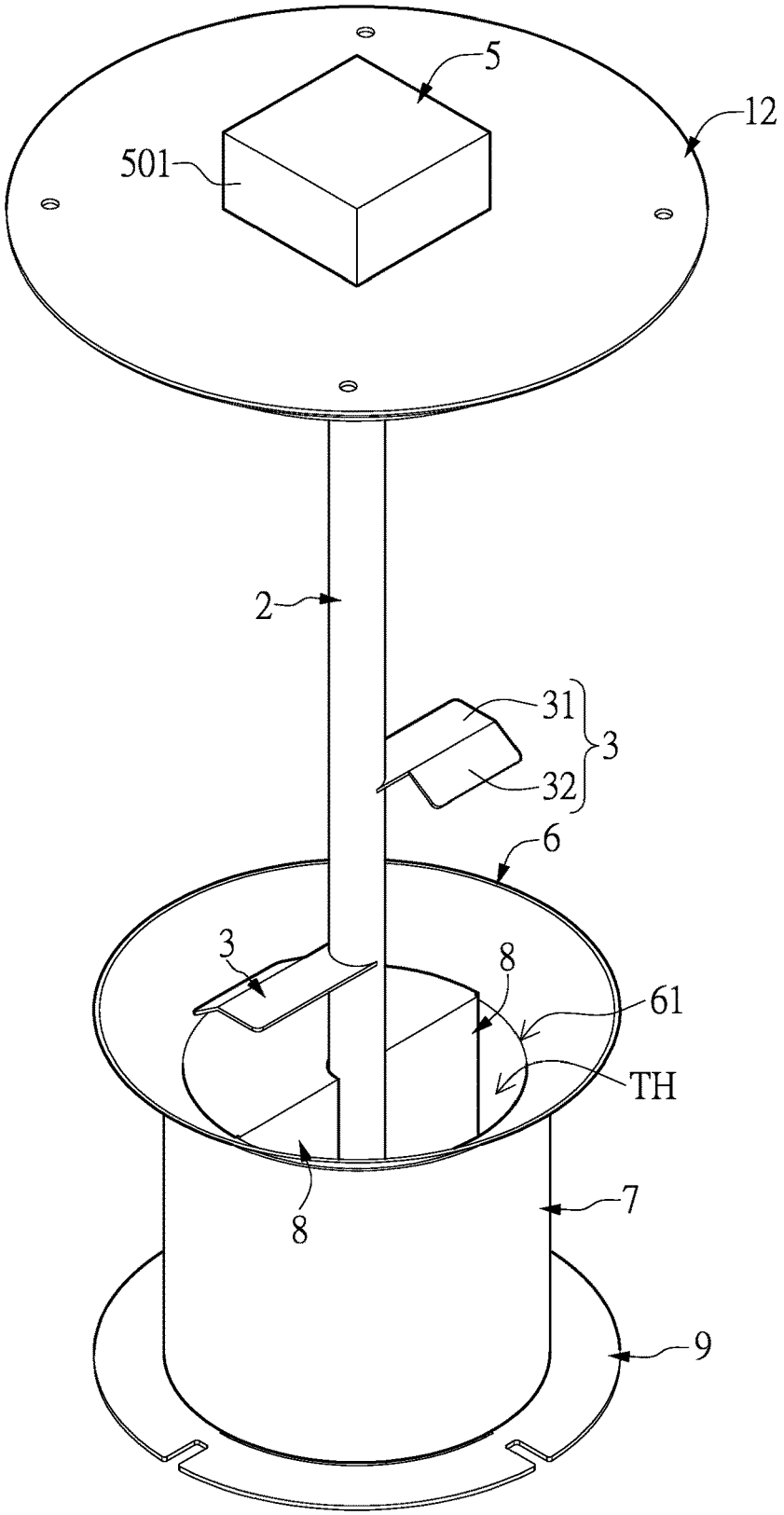
FIG. 5 is a partial schematic perspective view of the intelligent ice supply device according to the second embodiment of the present disclosure.

The elastic baffle 8 is fixed vertically on the bottom of the ice receiving tray 6 as shown in FIG. 4 and extends downward into the ice bucket 7, and an ice dropping channel TH (or an ice falling channel) corresponding to the first ice outlet opening 61 is formed between the wall of the elastic baffle 8 and the inner periphery of the ice bucket 7 as shown in FIG. 5, so that a part of the ice cubes on the ice receiving tray 6 can pass through the first ice outlet opening 61 and fall down into the ice dropping channel TH. In this embodiment, there are two elastic baffles 8 arranged side by side, or there are four elastic baffles 8 that can also be arranged side by side. Moreover, a semi-circular ice dropping channel TH corresponding to the semi-circular first ice outlet opening 61 is formed between the walls of the two elastic baffles 8 and the inner periphery of the ice bucket 7. It is worth mentioning that the elastic baffle 8 of this embodiment is made of elastic material (i.e., a material with a certain degree of resilience), and it is preferably a composite material based on a polymer main material containing a thermosetting elastomer (such as a silicone elastomer), so that it has the characteristics of high resilience, low deformation rate, and low embrittlement temperature.

The agitating bar 2 of the this embodiment passes through the ice receiving tray 6, so that the ice partitions 4 are positioned below the elastic baffle 8, and the inner edge of the ice partition 4 is connected to the outer peripheral edge of the agitating bar 2, and the outer edge of the ice partition 4 can be connected to the inner wall surface of an outer frame 401, so that the outer frame 401 is rotatably located in the ice bucket 7 and below the elastic baffle 8. The outer frame 401 of this embodiment is preferably a circular outer frame, but may also be an oval or square outer frame. In this embodiment, there are four ice compartments PA (or ice receiving spaces), but not limited thereto, and at least one ice compartment PA can communicate with the ice dropping channel TH. That is to say, at least one ice compartment PA can be rotatably communicated to the ice dropping channel TH, so that the ice cubes can drop down from the ice dropping channel TH into at least one ice compartment PA. Moreover, the elastic baffle 8 can prevent a large number of the ice cubes from directly falling into these ice compartments PA. The ice compartment PA of this embodiment is a fan-shaped compartment, but it can also be a semi-circular or square compartment. The ice compartment PA of this embodiment can be formed between the outer frame 401 and the ice partitions 4. Moreover, each agitating plate 3 of this embodiment has a horizontal piece 31 and a slanted piece 32 extending obliquely from the long side of the horizontal piece 31.

Figure 6:
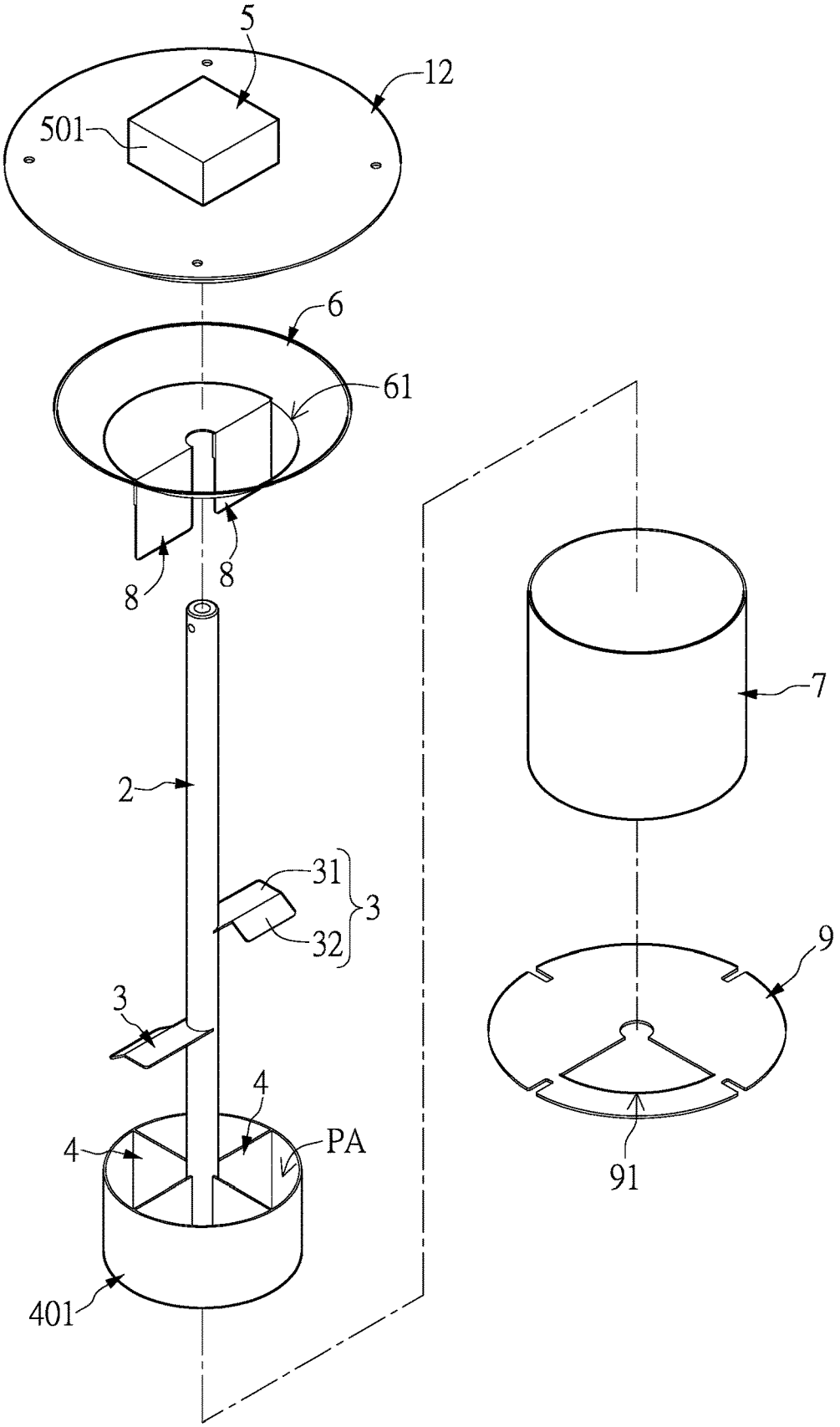
FIG. 6 is a partial schematic perspective exploded view of the intelligent ice supply device according to the second embodiment of the present disclosure.
Figure 7:
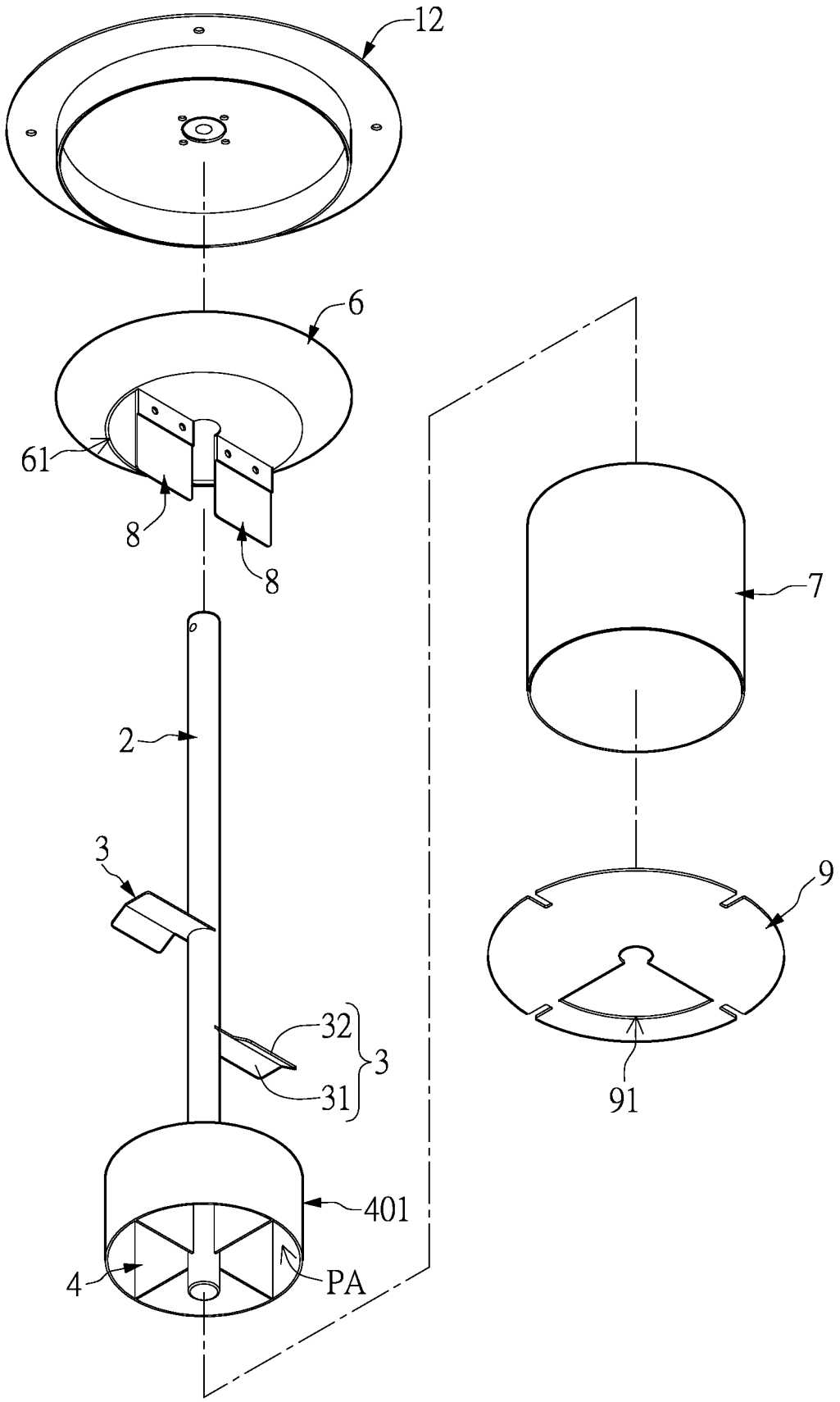
FIG. 7 is another partial schematic perspective exploded view of the intelligent ice supply device according to the second embodiment of the present disclosure.

The ice outlet tray 9 is fixed in the ice storage container 1 and located below the ice bucket 7 as shown in FIG. 3. The ice outlet tray 9 of this embodiment is circular, but it can also be square, and the edge of the lower side portion 22 of the agitating bar 2 extends downward through the center of the ice outlet tray 9. Moreover, as shown in FIG. 6 and FIG. 7, the ice outlet tray 9 is formed with a second ice outlet opening 91 (or a second ice falling opening) for the ice cubes to fall downward through the second ice outlet opening 91, which can communicate with at least one ice compartment PA and the ice outlet 11 under the ice storage container 1, so that the ice cubes can be discharged to the outside of the ice storage container 1 through at least one ice compartment PA, the second ice outlet opening 91, and the ice outlet 11. In this embodiment, the ice outlet tray 9 has a fan-shaped second ice outlet opening 91 corresponding to the fan-shaped ice compartment PA.

Figure 8:
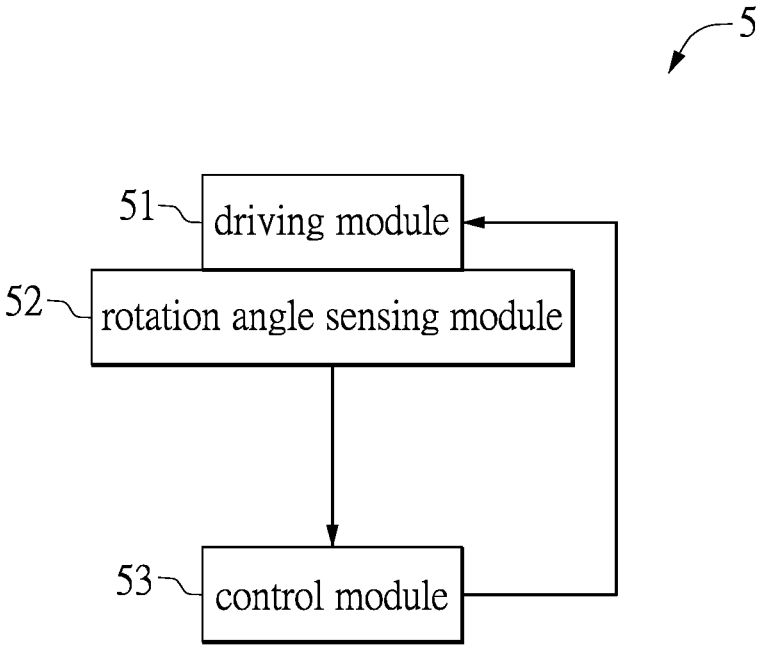
FIG. 8 is a functional block diagram of the intelligent ice supply device according to the second embodiment of the present disclosure.

The driving device 5 of this embodiment may have an installation casing 501 fixedly mounted on the top cover 12 as shown in FIG. 4. Moreover, the driving device 5 may have a driving module 51, a rotation angle sensing module 52 and a control module 53 as shown in FIG. 8.

The driving module 51 may be or include a driving motor, the driving motor may be a stepping motor, and the upper side portion 21 of the agitating bar 2 may be a rotating shaft 510 connected to the stepping motor. In addition, a speed reducer (or reduction gears) can be further provided between the rotating shaft 510 of the stepping motor and the motor to provide low-speed, high-torque power output, thereby certainly controlling the rotation angle of the rotating shaft 510 and increasing the agitating torque.

The rotation angle sensing module 52 can be used to detect the rotation angle of the rotating shaft 510 of the motor, and correspondingly output a rotation angle data. The rotation angle sensing module 52 of this embodiment is, for example, or includes an optical encoder, but can also be a Hall effect magnetic encoder or other sensors, it is not limited in the present disclosure. Furthermore, the rotation angle sensing module 52 of this embodiment can be a high-resolution optical encoder, because a high-resolution optical encoder can generate more pulse signals, so that the detected rotation angle of the rotating shaft 510 can be finer. In addition, the driving module 51 and the rotation angle sensing module 52 of this embodiment can also be integrated together, so that the driving module 51 can be a stepping motor with an optical encoder.

The control module 53 is electrically connected to the driving module 51 and the rotation angle sensing module 52. The control module 53 of this embodiment may be or include a microcontroller (MCU) or other controllers, and may be disposed inside or outside the installation casing 501. Moreover, the control module 53 can send a first control signal to the driving module 51 according to an external command, so that the driving module 51 can drive the rotating shaft 510 to rotate a target rotation angle so as to control the amount of ice output (that is to say, when taking one ice compartment PA as a unit to rotate the ice compartments PA, the positions of the ice compartments PA can be adjusted so as to provide a predetermined amount of ice cubes that is received in the corresponding ice compartment PA in advance), and according to the read rotation angle data, the angle difference between the actual rotation angle of the rotating shaft 510 and the target rotation angle is judged to perform position feedback control, thereby adjusting the rotation angle of the rotating shaft 510 to achieve precise positioning of the rotating shaft 510. Next, it can be judged according to the angle difference whether there is a phenomenon of ice jamming When it is judged that there is a phenomenon of ice jamming, a second control signal can be sent to the driving module 51 to make the driving module 51 drive the rotating shaft 510 to vibrate and then rotate clockwise and counterclockwise, thereby synchronously driving the ice partitions 4 rotates clockwise and counterclockwise, so that the ice cubes above the ice partitions 4 are elastically pushed by the elastic baffle 8 to eliminate the phenomenon of ice jamming Furthermore, even if it is judged that the phenomenon of ice jamming does not occur, the accumulated angle difference will form a cumulative error for a period of time, so that the control module 53 judges whether the accumulated angle difference exceeds a predetermined maximum allowable value, and when it is judged that the accumulated angle difference exceeds the predetermined maximum allowable value, the automatic return function can be activated (that is to say, the third control signal is sent to the driving module 51, so that the driving module 51 drives the rotating shaft 510 to automatically return to the predetermined initial position).

Third Embodiment

Figure 9:
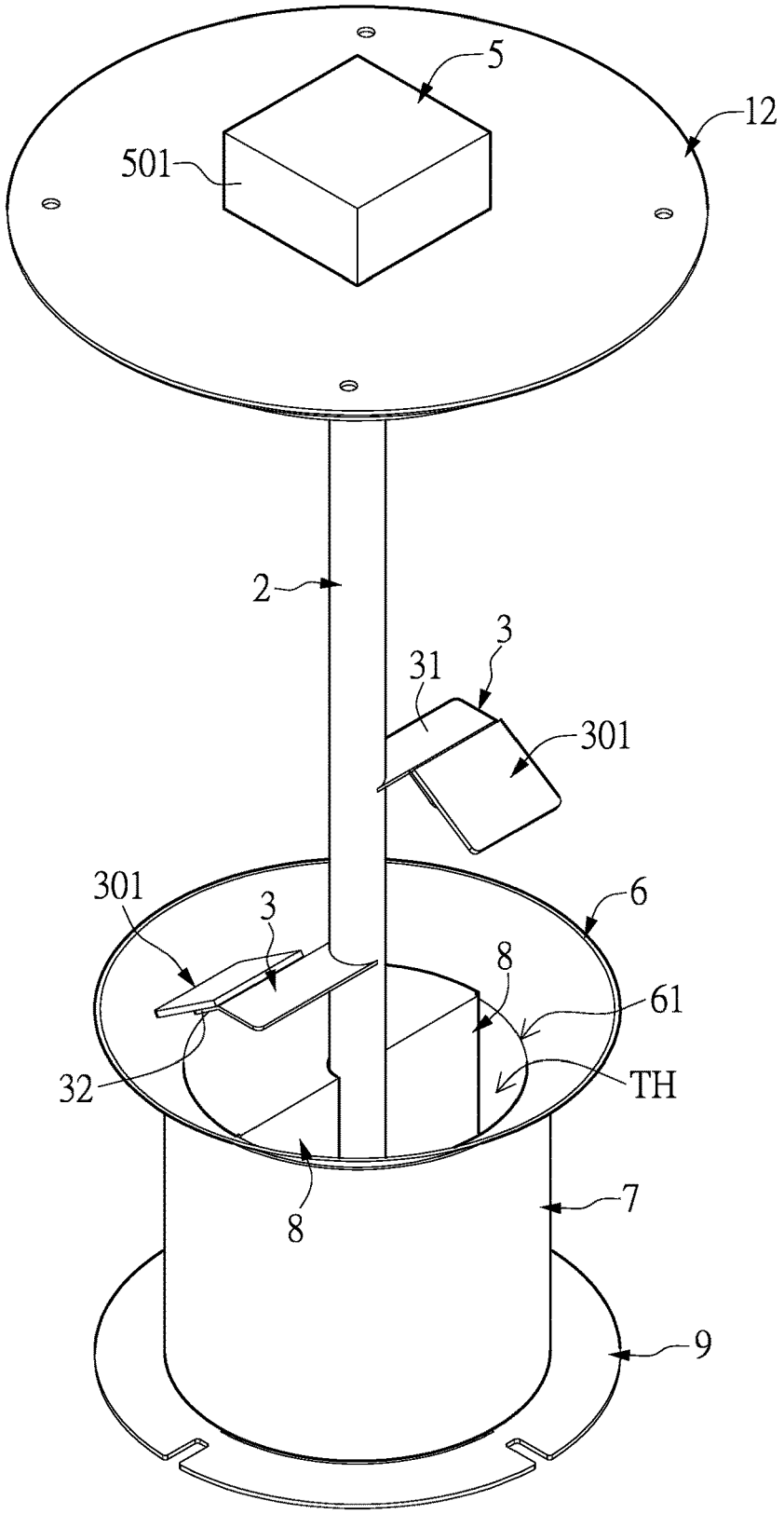
FIG. 9 is a partial schematic perspective view of the intelligent ice supply device according to a third embodiment of the present disclosure.

Please refer to FIG. 9, which is the third embodiment of the present disclosure. The structure of this embodiment is substantially the same as that of the second embodiment, and the differences are as follows.

In the this embodiment, the slanted piece 32 of each agitating plate 3 is also provided with an elastic plate body 301 made of elastic material, which can be used as a buffer to prevent a large amount of ice cubes from falling directly when the agitating plates 3 rotate to stir the ice cubes.

Fourth Embodiment

Figure 10:
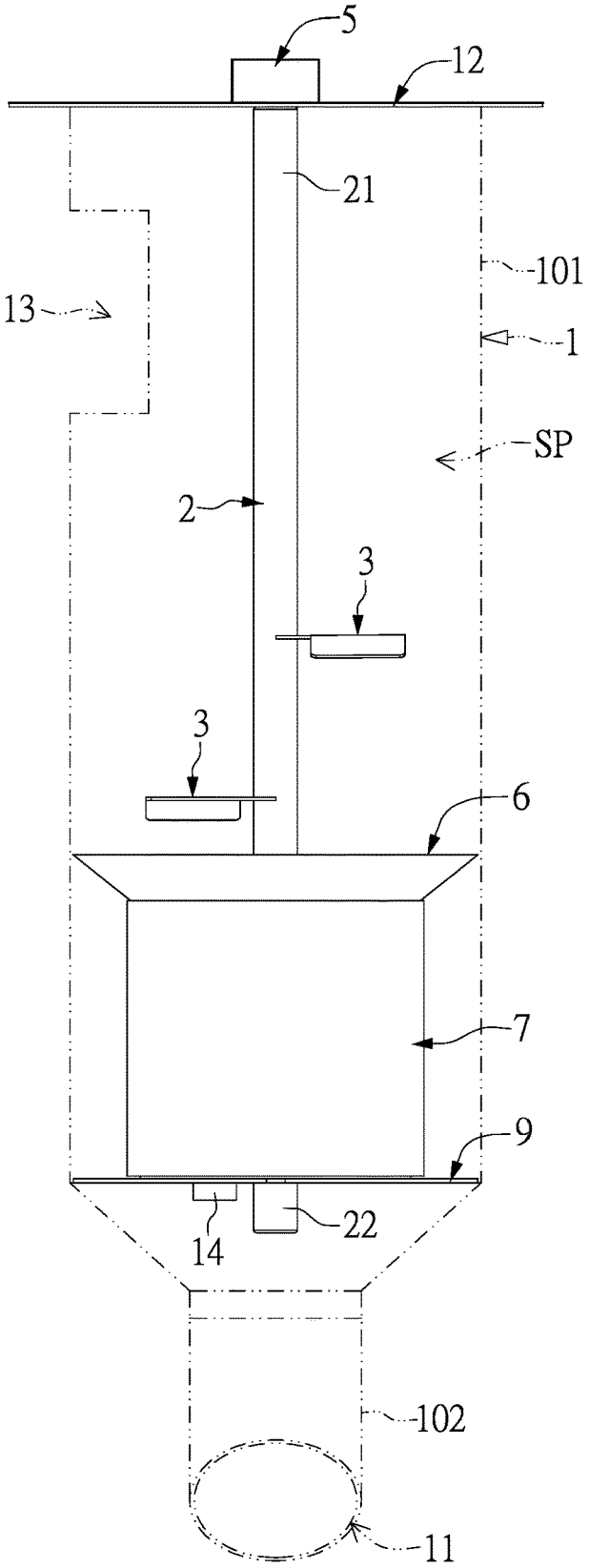
FIG. 10 is a schematic view of the intelligent ice supply device according to a fourth embodiment of the present disclosure.

Please refer to FIG. 10, which is the fourth embodiment of the present disclosure. The structure of this embodiment is substantially the same as that of the second embodiment, and the differences are as follows.

This embodiment provides an intelligent ice supply device, which is provided with a weight sensor 14 in the lower half of the ice storage container 1, for example, under the ice outlet tray 9, which can be connected with the control module 53 as shown in FIG. 8 so as to sense changes in the weight of the ice cubes, and output a weight data corresponding to the sensed weight changes to the control module 53, so that the control module 53 can grasp the remaining amount of ice cubes in the ice storage container 1 at any time, so as to send a reminder message to timely notify and remind the user to replenish new ice cubes.

Fifth Embodiment

Figure 11:
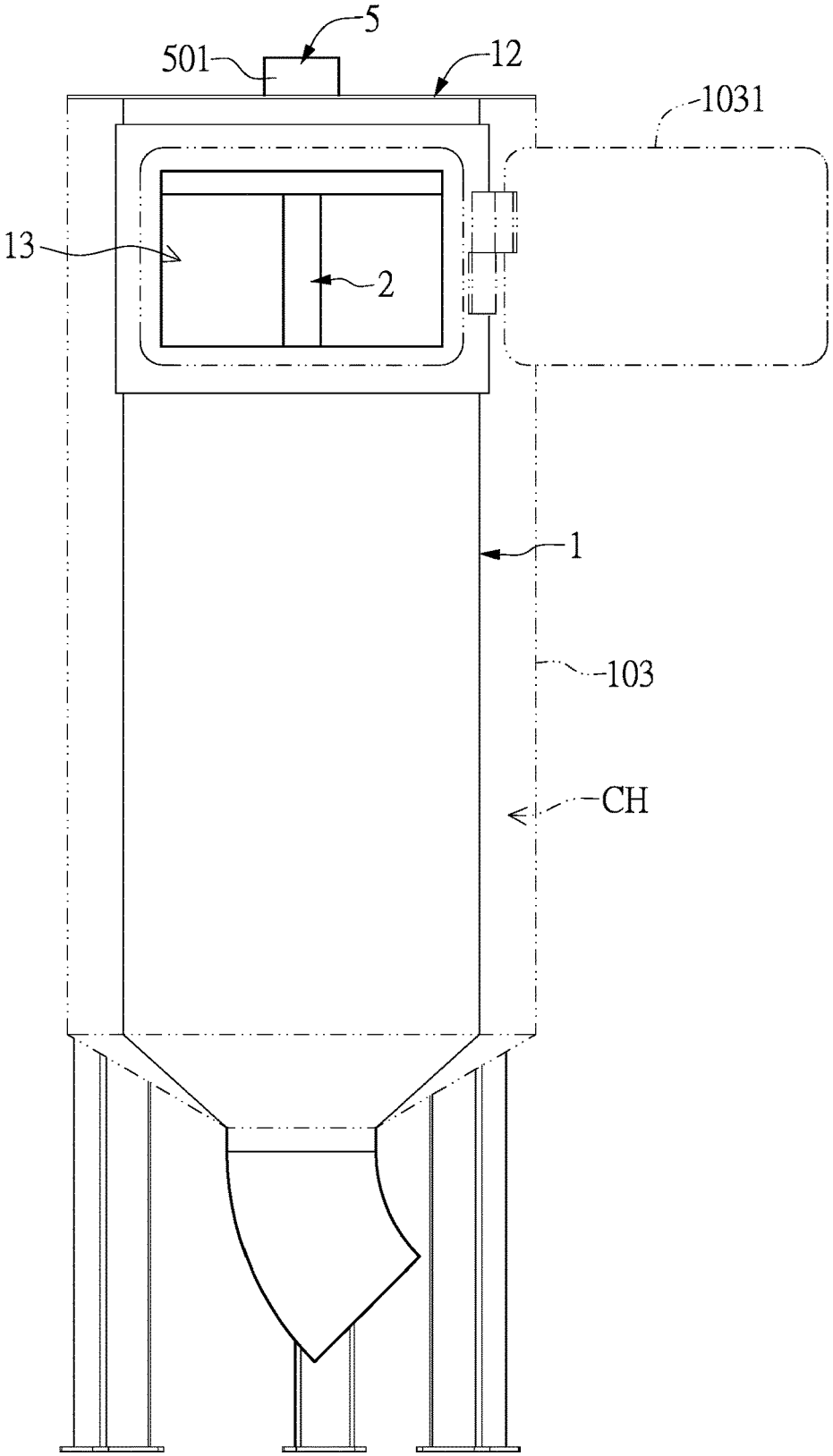
FIG. 11 is a schematic view of the intelligent ice supply device according to a fifth embodiment of the present disclosure.

Please refer to FIG. 11, which is the fifth embodiment of the present disclosure. The structure of this embodiment is substantially the same as that of the second embodiment, and the differences are as follows.

This embodiment provides an intelligent ice supply device, which further includes an outer bucket body 103 with an outer cabin door 1031. The ice storage container 1 is arranged in the outer bucket body 103, and the outer cabin door 1031 can be opened to expose the ice inlet 13 of the ice storage container 1 for the ice cubes to be put in. Moreover, there is a cavity CH between the outer bucket body 103 and the ice storage container 1, and the cavity CH can also be filled with heat-insulating materials such as polyurethane to further enhance the heat-insulating effect.

Sixth Embodiment

Figure 12:
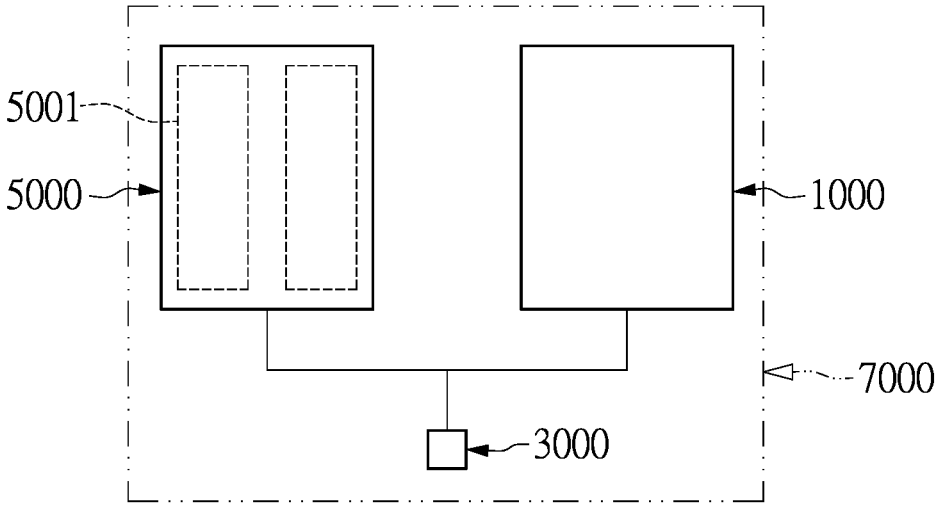
FIG. 12 is a schematic view of an intelligent beverage mixing apparatus according to a sixth embodiment of the present disclosure.

Please refer to FIG. 12, which is the sixth embodiment of the present disclosure. In this embodiment, an intelligent beverage mixing apparatus 7000 is provided, which is used for mixing beverages and pouring the prepared beverages into at least one drinking cup. The intelligent beverage mixing apparatus 7000 may include some or all of the elements in the patent number TWI737553, which may be appropriately changed depending on the actual design requirements, but the present disclosure is not limited thereto.

Furthermore, a storage device 5000 and an intelligent ice supply device 1000 described in any one of the foregoing embodiments may be provided inside the intelligent beverage mixing apparatus 7000. The storage device 5000 includes at least one outlet, which can be connected with the ice outlet of the intelligent ice supply device 1000 through any type of collecting mechanism 3000. In detail, the storage device 5000 may include a plurality of beverage barrels 5001 for storing beverages or liquid materials, such as fresh milk, tea, boiled water, sugar water, etc., as materials for mixing beverages. Moreover, the intelligent beverage mixing apparatus 7000 can add appropriate amount of ice cubes to the beverage through the intelligent ice supply device 1000 during the beverage mixing process according to the input beverage demand data (such as commodity, sugar content, ice amount, etc.), so that it can automatically supply prepared beverages to users according to the input beverage demand data.

In conclusion, the intelligent ice supply device provided by the embodiment of the present disclosure and the apparatus with the intelligent ice supply device can be provided with a plurality of ice partitions located on the lower side portion of the agitating bar so as to limit the amount of ice cubes falling from the intelligent ice supply device. In addition, the driving device can be connected to the upper side portion of the agitating bar, the driving device can be used to drive the agitating bar, the agitating plates and the ice partitions to rotate, so as to automatically supply the ice cubes, and the driving device can also be used to drive the agitating bar, the agitating plates and the ice partitions to vibrate, so as to automatically eliminate the phenomenon of ice jamming Therefore, the intelligent ice supply device of the present disclosure can not only automatically supply the ice cubes according to different requirements, but also reduce and automatically eliminate ice jamming The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An ice supply device configured to automatically supply ice cubes and automatically eliminate a phenomenon of ice jamming, comprising:

an ice storage container having an ice outlet;

an agitating bar rotatably disposed in the ice storage container, wherein the agitating bar has an upper side portion and a lower side portion respectively disposed on two opposite sides thereof;

a plurality of agitating plates horizontally connected to the agitating bar and disposed between the upper side portion and the lower side portion of the agitating bar;

a plurality of ice partitions vertically connected to the lower side portion of the agitating bar; and a driving device connected to the upper side portion of the agitating bar and configured to rotate the agitating bar, the agitating plates and the ice partitions so as to automatically supply the ice cubes, and the driving device being configured to vibrate the agitating bar, the agitating plates and the ice partitions so as to automatically eliminate the phenomenon of ice jamming.

2. The ice supply device according to claim 1, wherein an ice receiving tray and at least one elastic baffle are vertically connected to a bottom of the ice receiving tray, and the agitating bar passes through the ice receiving tray so as to position the ice partitions below the at least one elastic baffle.

3. The ice supply device according to claim 1, wherein each of the agitating plates has a horizontal piece and a slanted piece extending obliquely from a long side of the horizontal piece.

4. The ice supply device according to claim 3, wherein each of the slanted pieces is provided with an elastic plate body.

* * * * *